US006672359B2

(12) United States Patent
Morris

(10) Patent No.: US 6,672,359 B2
(45) Date of Patent: Jan. 6, 2004

(54) VALANCE MOUNTING SYSTEM AND METHOD

(75) Inventor: John E. Morris, Lake Mills, WI (US)

(73) Assignee: Springs Window Fashions LP, Middleton, WI (US)

( * ) Notice: Subject to any disclaimer, the term of this patent is extended or adjusted under 35 U.S.C. 154(b) by 0 days.

(21) Appl. No.: 10/162,003

(22) Filed: Jun. 3, 2002

(65) Prior Publication Data

US 2003/0221794 A1 Dec. 4, 2003

(51) Int. Cl.[7] ..... E04F 10/00

(52) U.S. Cl. ..... 160/38; 160/19; 160/39; 160/902; 248/206.5; 248/316.5

(58) Field of Search ..... 160/38, 39, 178.1, 160/902; 248/206.5, 316.5, 354.3; 24/499, 67.11, 573.1; 16/94 D, 95 D, 94 R

(56) References Cited

U.S. PATENT DOCUMENTS

| | | | | |
|---|---|---|---|---|
| 3,111,162 A | | 11/1963 | Bierlich | |
| 4,079,770 A | * | 3/1978 | Woodle | 160/19 |
| 4,260,043 A | | 4/1981 | Remington | |
| 4,272,047 A | * | 6/1981 | Botka | 248/74 PB |
| 4,399,856 A | | 8/1983 | Anderson | |
| 4,571,134 A | * | 2/1986 | Beglinger et al. | 411/41 |
| 4,667,914 A | | 5/1987 | Bailey | |
| 5,012,850 A | | 5/1991 | Schrader | |
| 5,188,162 A | | 2/1993 | Simon et al. | |
| 5,232,039 A | * | 8/1993 | Shapiro et al. | 160/330 |
| 5,259,520 A | | 11/1993 | Roggio et al. | |
| 5,577,303 A | | 11/1996 | Sacks et al. | |
| D377,600 S | | 1/1997 | Sacks et al. | |
| 5,655,590 A | | 8/1997 | Bryant | |
| 5,908,179 A | | 6/1999 | Fimbres | |
| 5,950,278 A | | 9/1999 | Collins | |
| D418,401 S | | 1/2000 | Anderson | |
| D418,744 S | | 1/2000 | Anderson | |
| D421,565 S | | 3/2000 | Jones et al. | |
| 6,315,026 B1 | * | 11/2001 | Ross | 160/38 |

FOREIGN PATENT DOCUMENTS

| | | | | |
|---|---|---|---|---|
| GB | 2154648 | * | 9/1985 | 411/41 X |

OTHER PUBLICATIONS

Two position adjustable valance clip (date unknown).
VELCRO® valance clip (date unknown).
Double layer valance clip (date unknown).
PVC channel and mounting clip system (date unknown).
Gilmore Enterprises, "Horizontal Component Catalog," Spring 2001.

* cited by examiner

*Primary Examiner*—Bruce A. Lev
(74) *Attorney, Agent, or Firm*—Lerner, David, Littenberg, Krumholz & Mentilk, LLP

(57) ABSTRACT

A vertically adjustable bracket for mounting a valance to a headrail includes a clip having a tongue and an arm for attachment to a headrail. A slide has a groove which receives the tongue and a twist and lock cam connector which releasably and lockingly engages an elongated groove on the rear of a valance. A rib on the slide and a ridged surface on the tongue make the bracket adjustable in small increments. Another embodiment includes a second tongue and groove connection which makes the horizontal distance between the valance and the headrail similarly adjustable.

51 Claims, 5 Drawing Sheets

VALANCE MOUNTING SYSTEM AND METHOD

FIELD OF THE INVENTION

This invention relates to valances which are mounted on the headrails of venetian blinds and other window coverings. More particularly, this invention relates to systems and methods for mounting valances to headrails in an attractive, efficient and economic manner.

BACKGROUND OF THE INVENTION

Window coverings such as venetian blinds typically include a headrail. Such headrails typically are U-shaped, with a generally horizontal bottom surface and generally vertical front and rear surfaces, each of which have an upper lip. Headrails are typically made from metal or another sturdy material in order to provide the structural integrity that is needed to suspend a venetian blind or other window covering. Headrails typically contain mechanisms for lifting and tilting the slats of the blind.

Venetian blinds are offered today in a broad spectrum of colors which allow the blinds to form an integral part of the design of a given room. The same, however, is not necessarily true of the headrails. Headrails often are available in only one or a small number of colors, and they generally do little to add to the aesthetic appeal of a blind; indeed, unadorned headrails may detract from the otherwise attractive appearance of a blind.

One popular solution to this problem has been the use of decorative valances which are mounted in front of the headrails in order to hide the headrails and provide an attractive look at the upper end of the window covering. Valances are typically provided in lengths which correspond to or which can be cut down to the width of a blind. Valances can be made of wood and may be milled into a variety of attractive cross-sectional shapes. They can also be made of extruded plastic. In either case, the valances can be given any desired color to match or coordinate with the color of the slats of the blind or other window covering material, or another color desired by the customer.

It is necessary, of course, to mount the valances on the headrail of the blind. To that end, a number of approaches have evolved, leading to a variety of existing mounting brackets and systems. A typical simple valance mounting bracket is made from a single piece of plastic. It will have a downwardly extending arm which slips over the upper lip of the front wall of the headrail. It will also have upper and lower extensions, one which extends over the top of the valance and then slightly down in front of the valance, while the other extends below the bottom of the valance and then slightly up in front of the valance.

This type of arrangement suffers from a number of drawbacks. For one, the upper and lower extensions typically must have shapes which correspond closely to the upper and lower surfaces of the valance in order to provide a solid grip. This means that different valance designs may require different mounting brackets.

Another problem with such existing mounting brackets is that portions of the upper and lower extensions are visible from the front of the valance when the valance is mounted. This tends to detract from the aesthetic appearance of the valance.

There is another variable among venetian blinds and other window coverings which make some existing valance clips inappropriate in certain environments. In particular, with certain blinds, it is desirable for the valance to be as close to being flush with the headrail as possible. However, with certain blinds that have a wand-like tilt rod extending from the front of the headrail, it is necessary and desirable to position the valance at some distance away from and in front of the headrail. A conventional valance clip which is designed to mount the valance flush to the headrail cannot be used in that circumstance, requiring a different mounting bracket.

One solution to this particular problem is illustrated in Anderson U.S. Pat. No. 4,399,856, which discloses an adjustable valance suspension bracket used in connection with a vertical blind headrail which has a downward facing opening. It employs a "base" which is custom designed to be mounted to the top of the headrail at horizontally oriented recesses. A "clip" is mounted on the "base" which has a T-shaped connecting means, and which can be adjustably connected to the base in order to vary the distance between the valance and the headrail.

The aforesaid Anderson '856 patent, however, illustrates another problem that has existed with some mounting brackets: they cannot be used to adjust the vertical positioning of the valance. In particular, there are sometimes installation circumstances which may require that a valance be raised to a slightly higher elevation. At least three solutions to that problem have evolved, none of which has proven completely satisfactory.

One solution is to provide the hook which is draped over the upper lip of the front wall of the headrail with two stops, one for installing the valance in a relatively low position and the other for installing the valance in a relatively high position. These two positions will typically differ by about a half-inch, which means that, in some circumstances, the installer may still be faced with the choice of having the valance either slightly too high or slightly too low, but not at the desired height.

Another approach, which provides greater flexibility and precision in selecting the height of the valance, involves the use of VELCRO® (or similar) hook-and-loop fastening material. In such schemes, a mounting bracket will be provided having an arm to hook over the upper lip of the front wall of the headrail, and a flat front surface upon which is mounted, e.g., a patch of the "loop" portion of the VELCRO® fastener. A patch of the "hook" portion of the VELCRO® is then mounted on the rear flat surface of the valance.

While this type of arrangement allows for small adjustments in the vertical positioning of the valance, it is not without drawbacks. For one, it can be expensive to provide both mounting brackets and valance material with patches the VELCRO® or similar material mounted thereon. If the VELCRO® is to be placed on the valance at the time of installation, this will add to the time required for installation and will create opportunities for errors, such as placing the VELCRO® at an inappropriate location on the rear of the valance. On the other hand, if VELCRO® is to be mounted on stock lengths of valance material, a judgment must be made as to the spacing of the VELCRO® patches and, in some instances, certain patches of VELCRO® will not be used, causing unnecessary cost and waste.

A third attempted solution to this problem involves the use of two components, a piece of extruded PVC channel and a plastic mounting clip. The PVC channel has a flat front surface adapted to be mounted flush with the flat rear surface of a valance, and a pair of prongs extending rearwardly. The mounting clip component has an arm adapted to be hooked onto the top of a headrail, and another pair of arms on the opposite side adapted to snap onto the prongs of the PVC channel. This scheme has the advantage of using common parts to attach a number of different valance profiles. However, the need to attach the PVC channel to the valance creates problems of labor, cost and waste. The PVC channel is typically attached to the rear of the valance with double-sided tape or some other adhesive vehicle, which could become unglued with the passage of time, elevated temperatures and other conditions. While it is sometimes possible to attach the PVC channel with staples, where the valance is a relatively thin piece of wood, staples may crack the valance, causing waste. Another problem associated with this scheme is that it requires accurate placement of the PVC channel at the time the PVC channel is mounted to the valance, since once the mounting is done, there is no further adjustability of the valance with respect to the headrail.

Accordingly, a need has arisen for a system and a method for mounting valances on headrails which is simple and inexpensive, and which provides for an installation scheme in which the aesthetic appearance of the valance is not marred by visible portions of mounting brackets. In addition, such a system and method should provide maximum flexibility so as to allow the valance to be as close to infinitely adjustable in the vertical direction as possible. In addition, such a system should also accommodate different types of installations in which the valance should either be flush with the headrail, or spaced away from the headrail to accommodate a wand-type tilt rod.

SUMMARY OF THE INVENTION

The present invention addresses the foregoing needs.

One aspect of the present invention provides a mounting bracket for mounting a valance to a window covering headrail of the type which has at least a vertically oriented front wall with an upper end. The mounting bracket comprises a clip having an arm adapted to hook onto the upper end of the front wall of a headrail. A slide is adjustably mounted to the clip to allow for relative vertical movement between the clip and the slide. An extension projecting from the slide is adapted to be attached to the valance.

In one preferred embodiment, the extension is a cam which is adapted to lockingly engage in a groove formed in a valance. In another preferred embodiment, the slide includes a groove, and the clip includes a tongue constructed and arranged to enter and slidably and adjustably move within the groove. As a further feature of the invention, either the groove or the tongue has a plurality of spaced parallel ridges, while the other member has a raised rib parallel to and facing the ridges, with the rib being adapted to snap into position between two ridges to releasably fix the relative vertical movement of the clip and the slide.

In one preferred embodiment of the present invention, the clip has a clip body from which the arm extends, and the spacing between the arm and the clip body allows a valance to be mounted substantially flush with the headrail. In another preferred embodiment, the spacing between the arm and the clip body allows the valance to be mounted a distance from the headrail which is sufficient to accommodate a tilt wand projecting from the headrail. In yet another preferred embodiment, one portion of the tongue is adapted to be broken off from the remainder of the tongue to shorten the tongue.

Another aspect of the present invention comprises a valance and mounting bracket assembly. The valance has a front surface and a rear surface, and a longitudinally extending groove on the rear surface. The groove has a first height at the rear surface and a second height at a position inward of the rear surface which is greater than the first height. The mounting bracket of the assembly has an arm adapted to be mounted on a window covering headrail, and a cam mounted on the mounting bracket. The cam has at least a maximum diameter and a smaller minimum diameter, with the minimum diameter being smaller than the first groove height, and the maximum diameter being greater than the first groove height and less than or substantially equal to the second groove height. The cam can be inserted transversely into the groove and then rotated with respect to the valance to form a tight fit between the mounting bracket and the valance.

Yet another aspect of the present invention provides a method of mounting a valance on a headrail. The method includes providing a headrail having a vertically oriented front wall with an upper end, a valance and a mounting bracket having a clip which includes an arm and having a separate slide adjustably mountable to the clip for relative movement therewith. The slide has an extension projecting therefrom. The method further includes the steps of attaching the extension to the valance, suspending the arm of the clip downwardly over the upper end of the front wall of a headrail, and slidably connecting the clip to the slide. In a preferred embodiment, the method also comprises the step of adjusting the relative positions of the clip and the slide to adjust the height of the valance.

In another preferred embodiment of the method aspect of the present invention, the valance has a front surface, a rear surface and a longitudinally extending groove on the rear surface. The groove has a first height at the rear surface and a second height at a position inward of the surface, with the second height being greater than the first height. The extension comprises a cam having at least a maximum diameter and a smaller minimum diameter, with the cam minimum diameter being smaller than the first groove height and the cam maximum diameter being greater than the first groove height and less than or substantially equal to the second groove height. The attaching step comprises inserting the cam transversely into the groove and then rotating the cam with respect to the valance to form a tight fit between the mounting bracket and the valance.

In yet another preferred embodiment, one of the clip and slide includes a tongue, the other includes a groove, with the tongue and groove providing the aforesaid relative movement, with the method further comprises the step of breaking off one end of the tongue to shorten its length.

Still another aspect of the present invention provides a mounting bracket for mounting a valance to a window covering headrail which comprises a first slide having an extension projecting therefrom and adapted to be attached to a valance. A second slide has at least one hook adapted to be connected to a headrail. An intermediate member has a first portion adjustably mounted to the first slide to allow for relative vertical movement between the first portion and the first slide. The intermediate member also comprises a second portion adjustably mounted to the second slide for relative horizontal movement between the second portion and the second slide.

Yet a further aspect of the present invention provides a method of mounting a valance on a headrail which includes a step of providing a headrail, a valance and a mounting bracket of the type previously described. The method further includes the step of attaching the extension of the first slide to the valance, attaching the hook of the second slide to the headrail, slidably connecting the first portion of the intermediate member to the first slide, and slidably connecting the second portion of the intermediate member to the second slide.

The present invention also resides in the various features set forth herein and combinations thereof.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION

Figure 1:
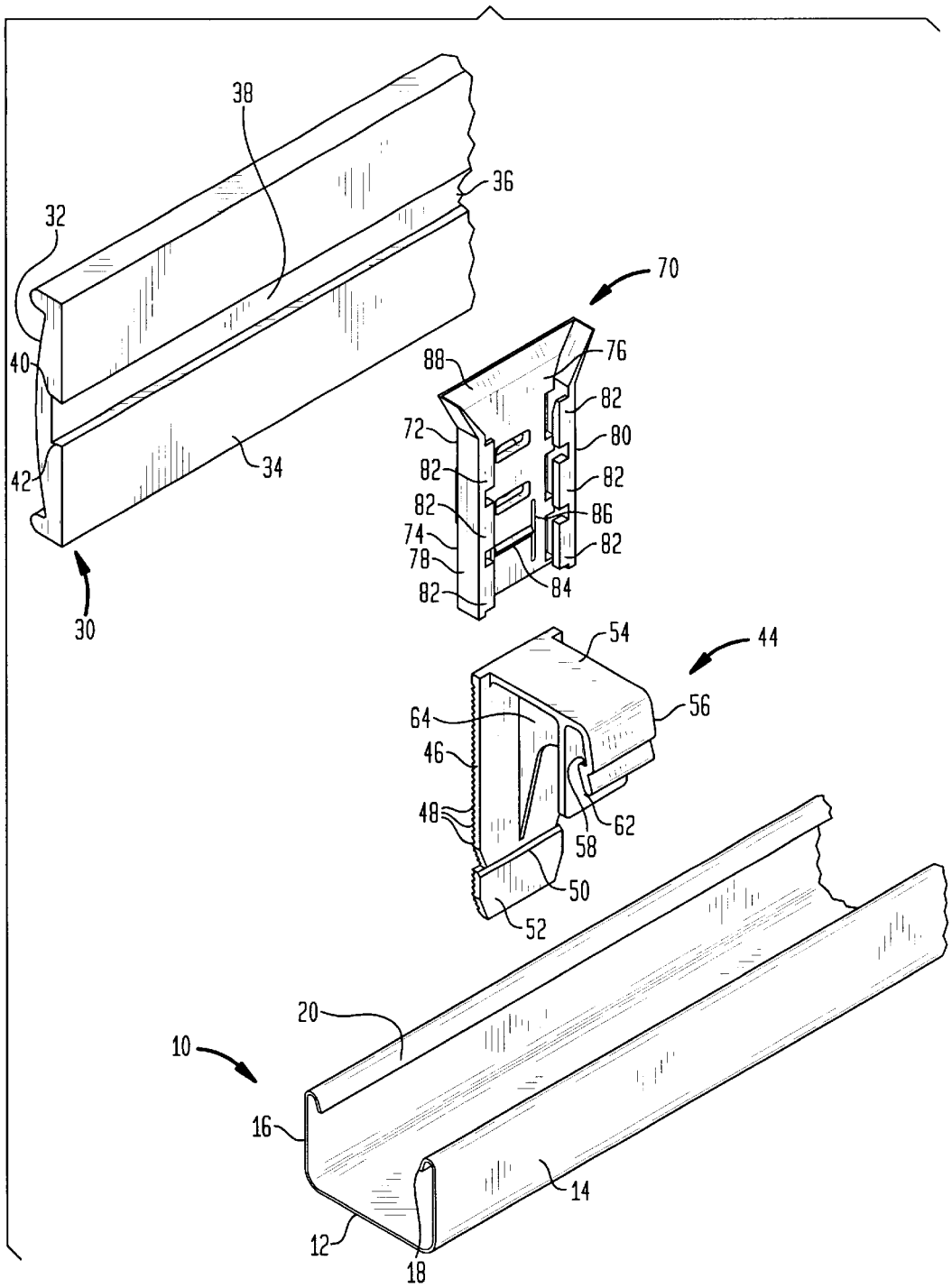
FIG. 1 is a perspective view of a headrail, a valance and one embodiment of the mounting bracket of the present invention in which no assembly has yet taken place.
Figure 2:
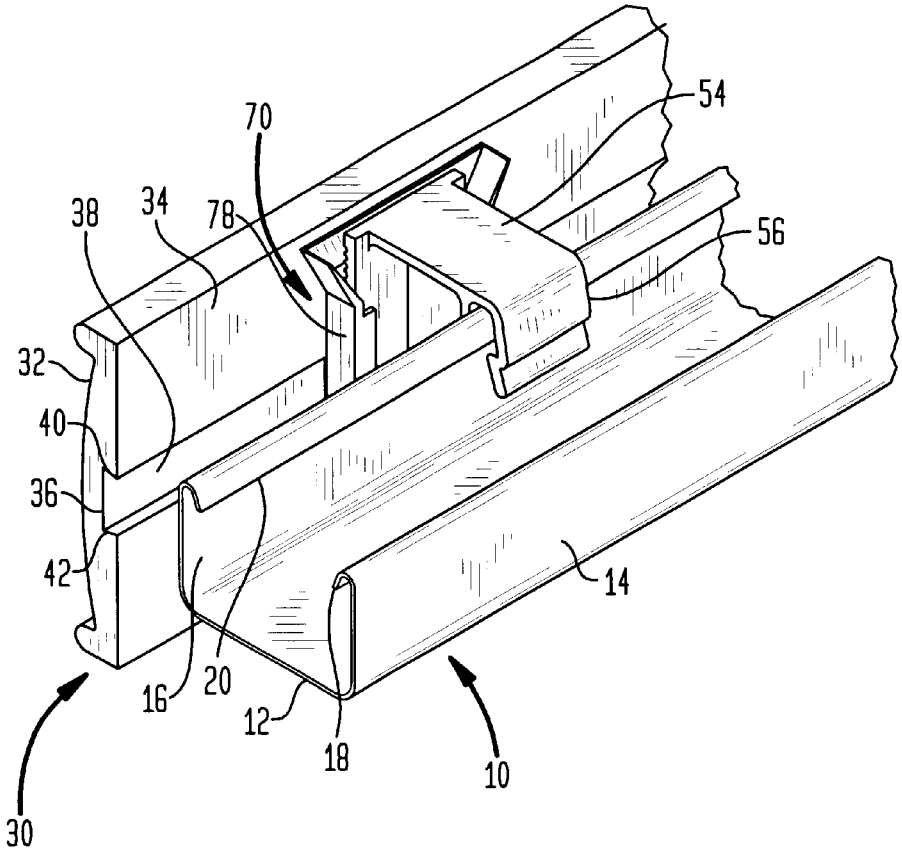
FIG. 2 is a perspective view of the embodiment of the mounting bracket illustrated in FIG. 1 in which the components of the mounting bracket have been assembled and connected to a headrail and a valance to show the valance mounted in front of the headrail.
Figure 3:
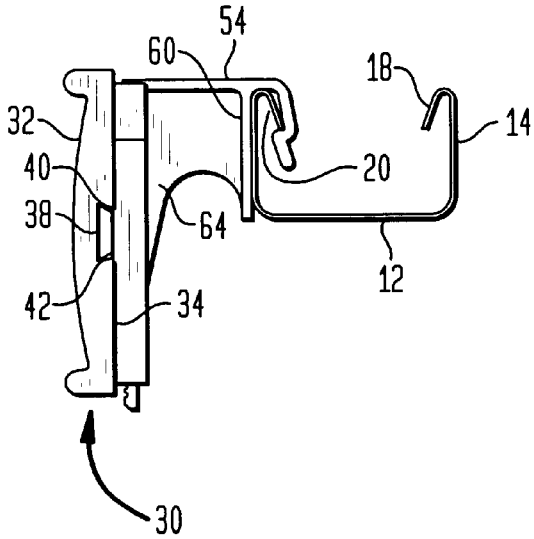
FIG. 3 is an end view of the assembly shown in FIG. 2.

A first preferred embodiment of the present invention is shown in FIGS. 1–5. As shown in FIG. 1, a headrail 10 is shown schematically to represent a typical headrail of a venetian blind or other window covering. As is known to those skilled in the art, headrails will typically contain therein mechanisms associated with the lifting and/or tilting of the components of the window covering, which components are not shown in FIG. 1. The headrail 10, which can be made of metal, plastic or other suitable material, has a generally flat, horizontally oriented bottom wall 12, a generally flat, vertically oriented rear wall 14, and a generally flat, vertically oriented front wall 16. Both rear wall 14 and front wall 16 have downwardly extending lips 18, 20. As will be explained more fully below, the lip 20 on front wall 16 is employed in the present invention to mount a valance.

The valance 30, which can be made of wood, plastic, or other suitable material, has a front wall 32 and a rear wall 34. The front wall 32 can and normally will be decorative. It can be molded or trimmed to a decorative shape and can be colored and/or otherwise decorated to provide any desired appearance, in ways which are known to those skilled in the art.

The rear wall 34 of the valance 30 has a longitudinally extending groove 36. The groove 36 can extend over a limited portion of the valance 30, but the greatest flexibility in mounting is achieved by having the groove 36 extend the entire length of the valance 30.

Figure 4:
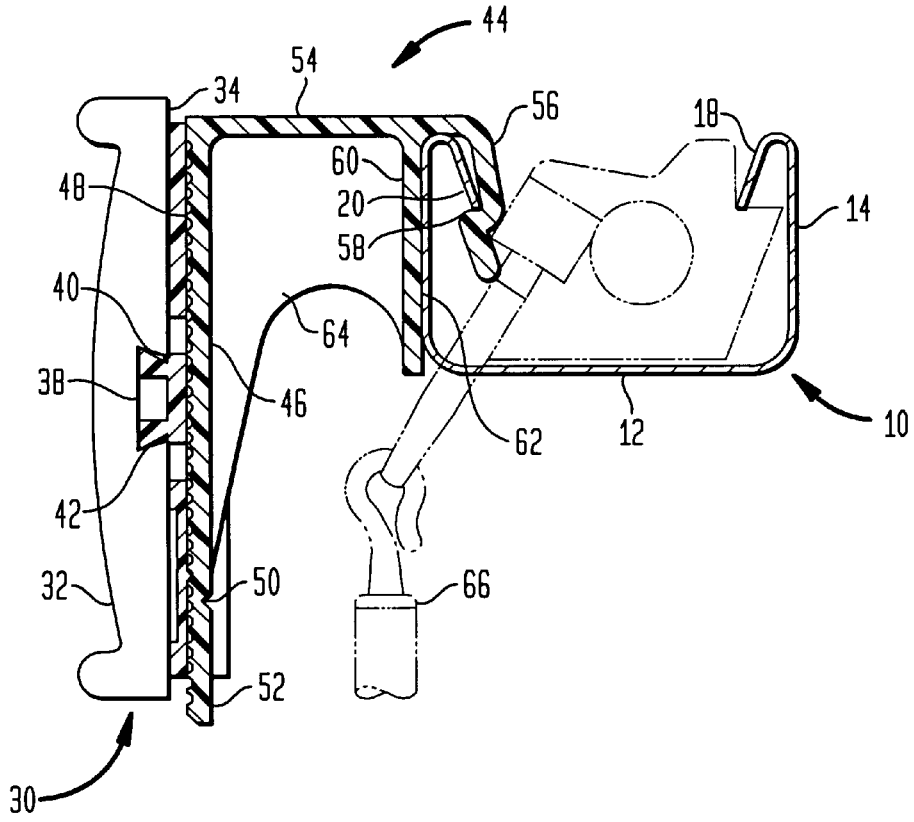
FIG. 4 is a sectional view of the assembly shown in FIGS. 2 and 3 to illustrate the spacing of the valance from the headrail to accommodate a tilt wand.

As best seen in FIGS. 1 and 4, the groove 36 is generally dovetailed in shape. More particularly, the opening of the groove 36 at the rear wall 34 has a first height, and at the innermost surface 38, the height of the groove is greater than the height at the rear wall 34. Between the opening of the groove 36 at the rear wall 34 and the innermost surface 38 are angled walls 40, 42. The importance of this height differential will become apparent momentarily.

It will be appreciated by those skilled in the art that the exact shape of the groove 36 can be varied. For example, the cross-sectional profile of the groove 36 could have a T-shape, in which there is a relatively narrow entrance to the groove 36 from the rear wall 34, which abruptly changes to a greater height at the interior of the groove 36.

The clip 44, which is preferably made of plastic material, has a vertically oriented tongue 46. As best seen in FIGS. 1 and 4, the tongue 46 has a series of spaced parallel ridges 48. For reasons that will be explained below, in a preferred embodiment of the present invention, the ridges are spaced apart at a pitch of approximately 1/16". The ridges 48 thus provide the tongue 46 of the clip 44 with a "washboard" type of surface.

The tongue 46 also includes, at its lower end, a weakened line 50. The weakened line 50 is an area of reduced thickness in the plastic material which renders the tongue 46 sufficiently thin at weakened line 50 that the bottom portion 52 can be snapped off if desired. As will become apparent below, this feature permits the user to avoid having a portion of the tongue 46 appear visible below the valance 30.

As best seen in FIG. 4, the clip 44 has a top surface 54 which extends rearwardly from the upper end of tongue 46. At the rearmost end, the top surface 54 becomes downwardly extending arm 56, which includes rearwardly extending ledge 58. It will be appreciated from FIG. 4 that the size and positioning of the ledge 58 is designed to snap into retaining engagement with the lip 20 of the headrail 10.

The clip 44 also includes a downwardly extending wall 60 which has a rear surface 62 which is adapted to rest flush against the front wall 16 of the headrail 10. Finally, the clip 44 also includes a web 64, which is best seen in FIGS. 1 and 4. The web 64 extends between the tongue 46, the top surface 54 and the downwardly extending wall 60 to provide the clip 44 with structural integrity.

As is best appreciated in FIG. 4, the embodiment of the clip 44 which has thus far been described provides substantial spacing between the arm 56 and the tongue 46. This spacing allows for the present invention to be employed in headrails which have a tilt wand mechanism 66 extending forward of the headrail. As will be discussed in connection with FIG. 6, the present invention also can be employed with a clip that does not provide such additional spacing and thus permits the valance to be mounted flush with the headrail.

Figure 5:
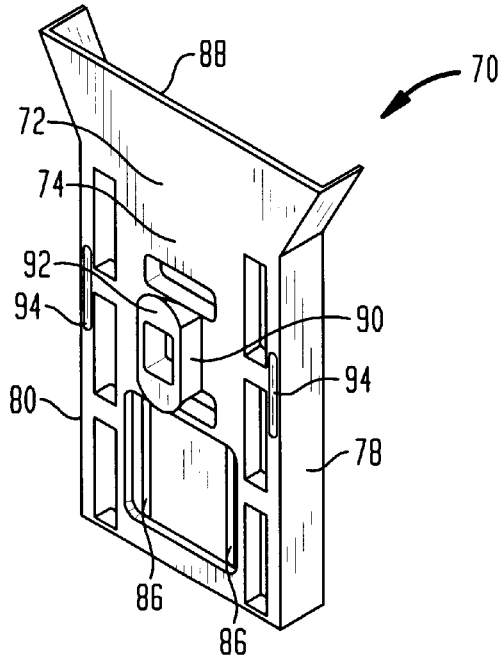
FIG. 5 is a perspective view of the slide portion of the mounting bracket of the present invention viewed from a frontal direction and showing the cam in greater detail.

The slide 70 of the present invention, which is also preferably made of plastic material, is best illustrated in FIGS. 1 and 5. The slide 70 has a generally vertically oriented front wall 72 having a front surface 74 and a rear surface 76. The slide 70 also includes side walls 78 and 80 at opposite ends of the front wall 72, and inwardly extending tabs 82 extending inwardly from both side walls 78 and 80. The front wall 72, side walls 78 and 80, and tabs 82 together form a groove. The size of the groove must be such as to accommodate the tongue 46 of the clip 44 in a fit which is tight but which has a small degree of flexibility, as more particularly described below.

The slide 70 also has a funnel-shaped opening 88 which consists of the upper portions of the side walls 78 and 80 angling outward. The funnel-shaped opening 88 facilitates the insertion of the tongue 46 of the clip 44 into the groove in the slide 70 defined by the front wall 72, the side walls 78 and 80 and the tabs 82.

On the rear surface 76 of slide 70 is positioned a horizontally oriented rib 84. The rib has a thin rearwardly pointing surface which is designed to nestle between two adjacent ridges 48 on the clip 44. On opposite ends of the rib 84 are openings 86, one of which is visible in FIG. 1, which extend above and below the rib 84. The two openings 86 allow the portion of the front wall 72 which includes the rib 84 to flex to a small degree when the tongue 46 moves past the ridges 48. It has been found that where the portion of the slide 70 between the openings 86 has a nominal thickness of about 0.040 inch (not including the rib 84), there is adequate flexure. This construction allows the clip 44 to be mounted to the slide 70 and to be adjustable for relative vertical movement of the clip 44 with respect to the slide 70.

It will be appreciated that the clip 44 and slide 70 are adjustable to a degree which is a function of the pitch between the ridges 48 on the clip 44. The pitch between the ridges 48 can be chosen at any desired distance. If the ridges 48 are spaced close together, the degree of adjustability of the clip 44 with respect to the slide 70 will be that much greater. On the other hand, positioning the ridges 48 too close together will prevent the clip 44 and slide 70 from remaining in engagement once the desirable setting is located. It has been found that a spacing between ridges 48 of approximately 1/16" provides good results.

As best seen in FIG. 5, projecting from the front wall 72 of the slide 70 is an extension or connector in the form of cam 90. The cam 90 extends forwardly from the front wall 72 and has a generally flat front surface 92 as seen in FIG. 4. The front face 92 has a generally oval shape which has a maximum diameter at its vertically oriented axis and a minimum diameter at its horizontally oriented axis. The height of the cam 90 decreases from a maximum at the front surface 92 to a minimum at the point at which the cam 90 abuts the front wall 72 of the slide 70. Also projecting from the front wall 72 are raised ribs 94 on both sides of the cam 90.

It will be recalled that the groove 36 in valance 30 was described as having a first height at the rear wall 34 and a greater height at the innermost surface 38. The cam 90 has a minimum diameter (i.e., the diameter at the horizontal axis) which is smaller than the height of the groove 36 at the rear wall 34. The maximum diameter of the cam (i.e., the diameter at the vertically oriented axis) is greater than the height of the groove 36 at the rear wall 34, and is preferably less than or substantially equal to the height of the groove 36 at the innermost surface 38.

It will thus be appreciated that, with the cam 90 and the groove 36 thusly dimensioned, the slide 70 can be releasably mounted to the valance. More particularly, referring again to FIG. 1, the slide 70 can be rotated 90° from the position shown in FIG. 1 in either direction, such that the maximum height of the cam 90 is now oriented in a horizontal direction. With that orientation, the slide 70 can be placed flush against the rear wall 34 of the valance 30 with the cam 90 entering the groove 36. The slide 70 is then rotated 90° so that the funnel-shaped opening 88 is now at the top, and the groove formed by the front wall 72, the side walls 78 and the tabs 82 is oriented vertically. The raised ribs 94 help create a snug fit. The slide 70 will now be lockingly but releasably engaged with the valance 30. If one wishes to move the slide 70 to a different location along valance 30, one need only twist the slide 70, remove it, reposition it, and then lockingly reengage it.

With the slide 70 thusly mounted to the valance 30, the clip 44 can be inserted into the slide 70. This is done by placing the bottom portion 52 of the clip 44 above the funnel-shaped opening 88 and moving the clip 44 downwardly with respect to the slide 70. The rib 84 will begin engaging the ridges 48 such that the clip 44 moves relative to the slide 70 in increments of approximately 1/16". It will also be appreciated that the clip 44 can be mounted to the slide 70 before the slide 70 is mounted to the valance 30.

With the slide 70 mounted to the valance 30, and the clip releasably positioned in the slide 70, the assembly consisting of the clip 44, the slide 70 and the valance 30 can then be mounted to the headrail 10. This is done by moving the clip 44 so that the arm 56 extends over and catches the downwardly extending lip 20 on front wall 16 of the headrail, until the lip 20 rests securely in the rearwardly extending ledge 58 of the clip 44. It will also be appreciated that the sequence of steps can be varied. For example, the clip 44 can be mounted to the headrail 10 before the clip 44 is engaged with the slide 70.

In the typical installation, two clips 44 and slides 70 will be employed, one on each end of the valance 30. The procedure just described is simply repeated a second time.

At this juncture, the valance 30 has been mounted to the headrail 10. However, vertical positioning of the valance may require adjustment. To accomplish such an adjustment, it is necessary to only nudge the valance upwardly or downwardly at each end of the valance as needed until the valance appears to be covering the headrail and positioned as to give a level appearance. There will be an audible click each time the rib 84 moves between ridges 48.

The foregoing adjustment step may result in some or all of the bottom portion 52 of the tongue 46 extending so low as to be visible from in front of the valance. Where that occurs, it is simply necessary to snap off the bottom portion 52 at the weakened line 50 and discard it.

Figure 6:
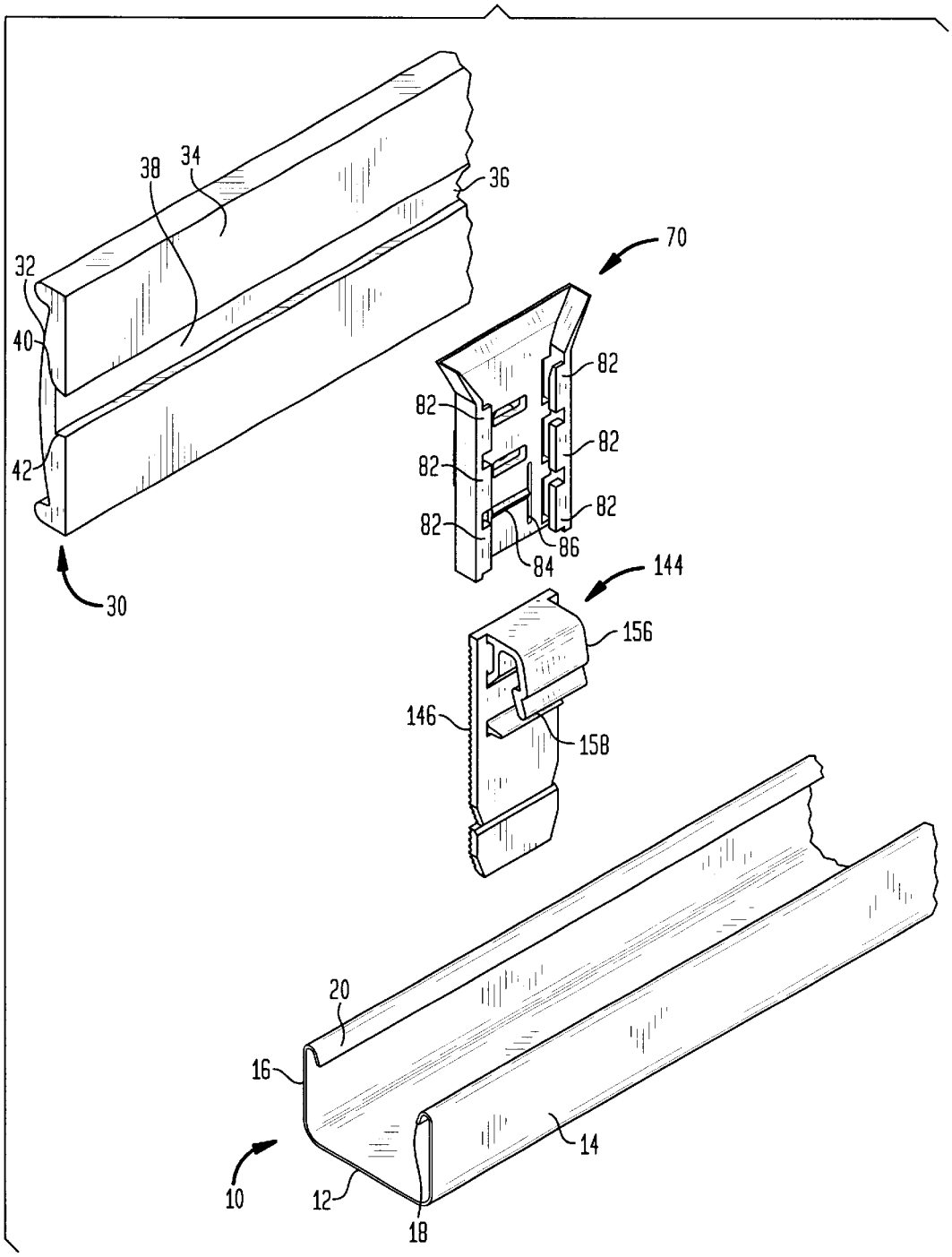
FIG. 6 is a perspective view, similar to FIG. 1, showing an alternative embodiment of the mounting bracket of the present invention which permits a valance to be mounted substantially flush to the front wall of the headrail.

FIG. 6 illustrates another preferred embodiment of the present invention. The headrail 10 and the valance 30 are the same as are shown in FIG. 1. Moreover, the slide 70 shown in FIG. 6 is identical to the slide 70 shown in FIGS. 1–5. The present embodiment differs only with respect to modified clip 144. The principal difference is that the arm 156 in the FIG. 6 embodiment is positioned much more closely to tongue 146 than is the case in the FIG. 1 embodiment. The clip 144 includes a rib 158 projecting rearwardly from the tongue 146 to rest against the front wall 16 of the headrail 10. The clip 144 will normally be used in environments in which it is desired and feasible to have the valance 30 mounted as close to flush as possible with respect to the headrail 10, e.g., situations which do not involve a tilt wand mechanism of the type shown in FIG. 4.

It will be appreciated that one advantage of the present invention is that the same slide 70 can be used with clip 44 as shown in FIGS. 1–4, and modified clip 144 as shown in FIG. 6. Thus, it is not necessary to inventory two different slides, but rather, one can maintain a relatively large inventory of slides 70 as well as separate inventories of clips 44 and 144. Depending upon the nature of the installation, the installer will choose either clip 44 or clip 144.

Figure 7:
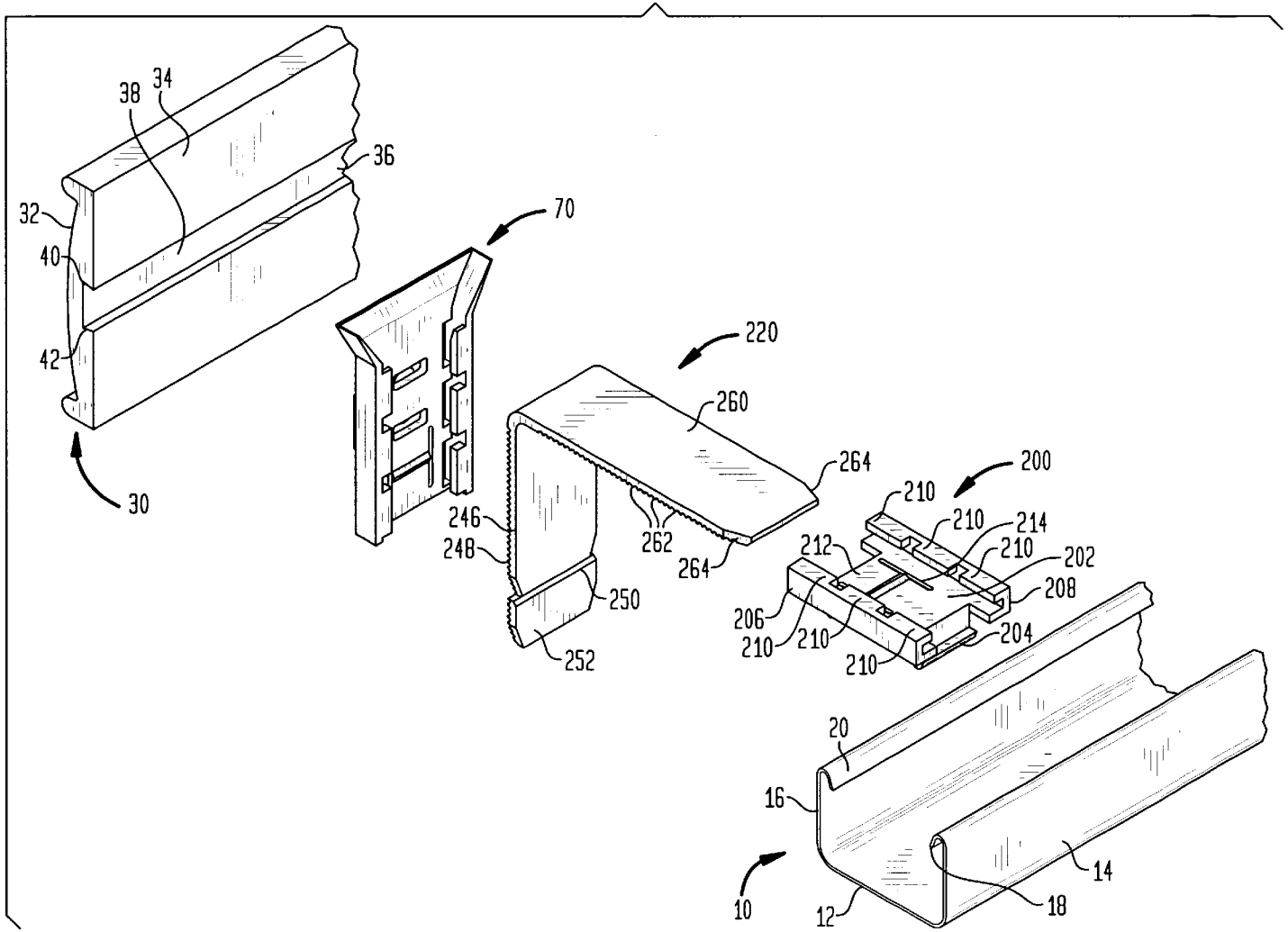
FIG. 7 is a perspective view of a further alternative embodiment of the present invention which allows the headrail to be adjusted both vertically and horizontally.

A further preferred embodiment of the present invention is illustrated in FIG. 7. In this embodiment, the headrail 10 is the same as embodiments previously discussed as is the valance 30 and the slide 70. This embodiment includes a second slide 200 which has a generally flat, horizontally oriented base 202. Suspended downwardly from the rearward portion of the base as seen in FIG. 7 is a first hook 204, and there is a similar second hook at the forward end of the base 202 which is not visible in FIG. 7. The width of the second slide 200 is approximately equal to the width of the headrail 10, and the first hook 204 is adapted to engage the lip 18 on rear wall 14. The other hook suspending downwardly from the base 202 is designed to similarly engage the lip 20 at the top of the front wall 16.

The second slide 200 has upwardly extending side walls 206 and 208, and extending inwardly from the upper portion of the side walls 206 and 208 are tabs 210. The combination of the base 202, the side walls 206 and 208, and the tabs 210 together form a groove in much the same way as was described in connection with the slide 70.

Extending upwardly from the base 202 is a rib 212, and on both sides of the rib 212 are openings 214. The construction of the rib 212 and the openings 214 are similar to the rib 84 and openings 86 described in connection with the slide 70, such that the portion of the base 20 between openings 214 can flex upwardly and downwardly.

The embodiment of FIG. 7 also includes an intermediate member 220. The intermediate member 220 is generally L-shaped. It includes a tongue 246 which is similar in construction to the tongue 46 in clip 44 discussed in connection with the embodiment of FIGS. 1–4. Thus, the tongue 246 has a bottom portion 252, and there is a weakened line 250 between the bottom portion 252 and the remainder of the tongue 246. The forward facing surface of the tongue 246 has ridges 248 which are similar to the ridges 48 described in connection with clip 44.

The intermediate member 220 also has a horizontally oriented second tongue 260. The lower surface of the second tongue 260 has ridges 262 which are similar to the ridges 248 which (again) are similar to the ridges 48 on the clip 44. The rearward end of the second tongue 260 has cut-off corners 264 to ease the insertion of the second tongue 260 into the second slide 200.

In the FIG. 7 embodiment, the tongue 246 is adapted to be inserted into and adjustably slidable with respect to the slide 70. The second tongue 260 is adapted to be inserted into and adjustably slidable with respect to the second slide 200. More particularly, the second tongue 260 is inserted through the groove in second slide 200 formed by the base 202, the side walls 206 and 208, and the tabs 210. The downwardly facing ridges 262 interact with the upwardly facing rib 212 to allow the relative position of the second tongue relative to the second slide to be adjustable. As discussed previously, the spacing of the ridges 262 may be approximately 1/16".

To assemble the embodiment in FIG. 7, the second slide 200 is mounted to the headrail by means of hooks 204. The intermediate member 220 is then mounted to the second slide 200 by inserting the second tongue 260 into the groove formed by the base 202, the side walls 206 and 208, and the tabs 210. The slide 70 is mounted to the valance 30 in the manner previously described. The valance 30 is then mounted to the headrail 10 by positioning the slide 70 under the tongue 246 and then moving the slide (with the valance 30) upward so that the tongue 246 enters the groove in slide 70.

It will now be appreciated that, in this embodiment, it is possible to adjust both the height of the valance 30 relative to the headrail 10, as well as the horizontal distance between the valance 30 and the headrail 10. The height is adjusted by moving the slide 70 upward or downward with respect to the intermediate member 220, in the same fashion as discussed in connection with previous embodiments. The horizontal distance is adjusted by moving the intermediate member 220 relative to the second slide 200 in a similar fashion. As in previous embodiments, the bottom portion 252 of the tongue 46 may be snapped off if it remains visible below the valance 30.

It will also be appreciated that the assembly steps just described can be done in various sequences. By way of example, one can first mount the slide 70 to the valance 30, then insert the intermediate member 220 into the slide 70, and then insert the second tongue 260 into the second slide 200. It is also possible in certain circumstances to first attach the slide 70 to the intermediate member 220, then attach the intermediate member 220 to the second slide 200, and then mount the valance 30 to the slide 70; however, it will be appreciated that doing so may require the valance 30 to be first rotated into a vertical position so that the cam 90 and slide 70 can enter the groove 36 on the valance 30, which may not be possible in some circumstances, particularly if two or more mounting brackets are used for a given valance.

The mounting bracket components can be made from any appropriate material which can be injection molded. Polycarbonate with a very fine EDM finish has proven to work satisfactorily.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A mounting bracket for mounting a valance to a window covering headrail having at least a vertically oriented front wall with an upper end, said mounting bracket comprising:

a) a clip having a longitudinally extending tongue and an arm adapted to hook onto the upper end of the front wall of a headrail;

b) a slide having a longitudinally extending front surface adjustably mounted to said tongue to allow for relative longitudinal movement between said clip and said slide; and c) an extension projecting from said front surface of said slide adapted to be attached to a valance.

2. A mounting bracket according to claim 1 wherein said extension is a cam adapted to lockingly engage in a groove formed in a valance.

3. A mounting bracket according to claim 1 wherein said slide includes a groove and wherein said tongue is constructed and arranged to enter and slidably and adjustably move within said groove.

4. A mounting bracket according to claim 3 wherein said slide has a funnel shaped opening to facilitate entry of said tongue into said groove.

5. A mounting bracket according to claim 3 wherein an end portion of said tongue is separated from the remainder of said tongue by a weakened line and is adapted to be broken off from the remainder of said tongue to shorten said tongue.

6. A mounting bracket according to claim 3 wherein one of said groove and said tongue has a plurality of spaced parallel ridges transverse to the direction of said movement and facing the other of said groove and said tongue, and wherein said other of said tongue and said groove has a raised rib parallel to and facing said ridges, said rib being adapted to snap into position between two of said ridges to releasably fix the relative longitudinal position of said clip and said slide.

7. A mounting bracket according to claim 6 wherein said ridges are formed on said tongue, and wherein said rib is formed on said groove.

8. A mounting bracket according to claim 6 or 7 wherein said rib is positioned between two parallel vertically oriented slots whereby said rib can flex into and out of position between two of said ridges.

9. A mounting bracket according to claim 1 wherein said slide is adjustable with respect to said clip in increments of approximately 1/16".

10. A mounting bracket according to claim 1 wherein said clip has a clip body from which said arm extends, and wherein the spacing between said arm and said clip body allows a valance to be mounted substantially flush with said headrail.

11. A mounting bracket according to claim 1 wherein said clip has a clip body from which said arm extends, and wherein the spacing between said arm and said clip body allows a valance to be mounted a distance from said headrail sufficient to accommodate a tilt wand projecting from the headrail.

12. A mounting bracket for mounting a valance to a headrail, said mounting bracket comprising:

a) a clip having a longitudinally extending tongue and an arm adapted to engage a headrail;

b) a slide having a longitudinally extending front surface adjustably mounted to said tongue to allow for relative longitudinal movement between said clip and said slide; and c) a connector mounted to said front surface for releasable attachment to a valance.

13. A valance and mounting bracket assembly comprising:

a) a valance having a front surface, a rear surface and an elongated groove on said rear surface, said groove having a first height at said rear surface and a second height at a position inward of said surface, said second height being greater than said first height;

b) a mounting bracket having an arm adapted to be mounted on a window covering headrail; and c) a cam mounted on said mounting bracket, said cam having at least a maximum diameter and a smaller minimum diameter, said cam minimum diameter being smaller than said first groove height, and said cam maximum diameter being greater than said first groove height and less than or substantially equal to said second groove height, whereby said cam may be inserted transversely into said groove and then rotated with respect to said valance to form a tight fit between said mounting bracket and said valance.

14. A valance and mounting bracket assembly according to claim 13 wherein said mounting bracket is formed with a first piece including said arm and a separate second piece including said cam, said first and second pieces being slidably movable with respect to each other to adjust the height of said valance.

15. A valance and mounting bracket assembly according to claim 13 further comprising a headrail having at least a vertically oriented front wall with an upper end, said mounting bracket arm being positioned over said headrail front wall upper end.

16. A valance and mounting bracket assembly according to claim 15 further comprising a window covering suspended from said headrail.

17. A valance and mounting bracket assembly according to claim 13 wherein said groove has a dovetail shape.

18. A valance and mounting bracket assembly according to claim 13 wherein said groove has a T-shape.

19. A method of mounting a valance on a headrail comprising:

a) providing a headrail having a vertically oriented front wall with an upper end, a valance, and a mounting bracket having a clip including a longitudinally extending tongue and an arm and having a separate slide having a longitudinally extending front face adjustably mountable to said tongue for relative longitudinal movement therewith, said slide having an extension projecting from said front face;

b) attaching said extension to said rear wall of said valance;

c) suspending said arm of said clip downwardly over said upper end of said front wall of said headrail; and d) slidably connecting said clip to said slide.

20. The method of claim 19 further comprising adjusting the relative positions of said clip and said slide to adjust the height of said valance.

21. The method of claim 20 wherein said adjusting is in increments of approximately 1/16".

22. A method according to claim 19 wherein said valance has a front surface, a rear surface and a longitudinally extending groove on said rear surface, said groove having a first height at said rear surface and a second height at a position inward of said surface, said second height being greater than said first height; wherein said extension comprises a cam having at least a maximum diameter and a smaller minimum diameter, said cam minimum diameter being smaller than said first groove height, and said cam maximum diameter being greater than said first groove height and less than or substantially equal to said second groove height; and wherein said attaching step comprises inserting said cam transversely into said groove and then rotating said cam with respect to said valance to form a tight fit between said mounting bracket and said valance.

23. The method of claim 22 wherein said rotating step comprises rotating said cam with respect to said valance by approximately 90 degrees.

24. A method according to claim 19 wherein one of said clip and said slide includes a tongue, the other of said clip and said slide includes a groove, said tongue and groove providing said relative movement, further comprising the step of breaking off one end of said tongue to shorten its length.

25. The method of claim 24 wherein said tongue is provided with at least one weakened line, and said breaking takes place along said weakened line.

26. A method according to claim 19 wherein said providing step includes providing first and second clips, each having a clip body from which the clip's arm extends by a different distance, said method further comprising the step of selecting a first or a second clip prior to said suspending step.

27. A method of mounting a valance on a headrail comprising:

a) providing a headrail, a valance, including a groove, and a mounting bracket having a clip including an arm and having a separate slide adjustably mountable to said clip for relative movement therewith, said slide having a connector mounted thereto;

b) lockingly and releasably attaching said connector to said valance by inserting said connector into said groove and rotating said connector relative to said valance;

c) attaching said arm of said clip to only a single wall of said headrail; and d) slidably connecting said clip to said slide.

28. A mounting bracket for mounting a valance to a window covering headrail comprising:

a) a first slide having an extension projecting therefrom and adapted to be attached to a valance;

b) a second slide having at least one hook adapted to be connected to a headrail;

c) an intermediate member having a first portion adjustably mounted to said first slide to allow for relative vertical movement between said first portion and said first slide, and a second portion adjustably mounted to said second slide for relative horizontal movement between said second portion and said second slide.

29. A mounting bracket according to claim 28 wherein said extension is a cam adapted to lockingly engage in a groove formed in a valance.

30. A mounting bracket according to claim 28 wherein said first slide includes a groove and wherein said first portion includes a tongue constructed and arranged to enter and slidably and adjustably move within said groove.

31. A mounting bracket according to claim 30 wherein said first slide has a funnel shaped opening to facilitate entry of said tongue into said groove.

32. A mounting bracket according to claim 30 wherein an end portion of said tongue is separated from the remainder of said tongue by a weakened line and is adapted to be broken off from the remainder of said tongue to shorten its length.

33. A mounting bracket according to claim 30 wherein one of said groove and said tongue has a plurality of spaced parallel ridges transverse to the direction of movement between said first slide and said first portion and facing the other of said groove and said tongue, and wherein said other of said tongue and said groove has a raised rib parallel to and facing said ridges, said rib being adapted to snap into position between two of said ridges to releasably fix the relative vertical position of said clip and said slide.

34. A mounting bracket according to claims 32 or 33 wherein said ridges are formed on said tongue, and wherein said rib is formed on said groove.

35. A mounting bracket according to claim 28 wherein said second slide includes a groove and wherein said second portion includes a tongue constructed and arranged to enter and slidably and adjustably move within said groove.

36. A mounting bracket according to claim 35 wherein one of said groove and said tongue has a plurality of spaced parallel ridges transverse to the direction of movement between said second slide and said second portion and facing the other of said groove and said tongue, and wherein said other of said tongue and said groove has a raised rib parallel to and facing said ridges, said rib being adapted to snap into position between two of said ridges to releasably fix the relative vertical position of said clip and said slide.

37. A mounting bracket according to claims 32, 33 or 36 wherein said rib is positioned between two parallel vertically oriented slots whereby said rib can flex into and out of position between two of said ridges.

38. A mounting bracket according to claim 28 wherein said first portion is adjustable with respect to said first slide in increments of approximately 1/16".

39. A mounting bracket according to claim 28 wherein said second portion is adjustable with respect to said second slide in increments of approximately 1/16".

40. A valance and mounting bracket assembly comprising:

a) a first slide having an extension projecting therefrom;

b) a second slide having at least one hook adapted to be connected to a headrail;

c) an intermediate member having a first portion adjustably mounted to said first slide to allow for relative vertical movement between said first portion and said first slide, and a second portion adjustably mounted to said second slide for relative horizontal movement between said second portion and said second slide; and d) a valance mounted to said first slide at said extension.

41. An assembly according to claim 40 wherein said valance has a front surface, a rear surface and a longitudinally extending groove on said rear surface, said groove having a first height at said rear surface and a second height at s position inward of said surface, said second height being greater than said first height, and said projection comprises a cam having at least a maximum diameter and a smaller minimum diameter, said cam minimum diameter being smaller than said first groove height, said cam maximum diameter being greater than said first groove height and less than or substantially equal to said second groove height, whereby said cam may be inserted transversely into said groove and then rotated with respect to said valance to form a tight fit between said mounting bracket and said valance.

42. An assembly according to claim 40 or 41 further comprising a headrail mounted to said second slide.

43. A method according to claim 42 or 44 wherein said adjusting is in increments of approximately 1/16".

44. A method of mounting a valance on a headrail comprising:

a) providing a headrail, a valance and a mounting bracket having a first slide with an extension projecting therefrom and adapted to be attached to a valance, a second slide having at least one hook adapted to be connected to a headrail, and an intermediate member having a first portion vertically adjustably mountable to said first slide and a second portion adjustably mountable to said second slide;

b) attaching said extension of said first slide to said valance;

c) attaching said hook of said second slide to said headrail;

d) slidably connecting said first portion of said intermediate member to said first slide for relative movement in a first direction; and e) slidably connecting said second portion of said intermediate member to said second slide for relative movement in a second direction.

45. A method according to claim 44 further comprising adjusting the relative positions of said first portion and said first slide to adjust the height of said valance.

46. A method according to claim 44 further comprising adjusting the relative positions of said second portion and said second slide to adjust the distance of the valance from the headrail.

47. A method according to claim 44 wherein said valance has a front surface, a rear surface and a longitudinally extending groove on said rear surface, said groove having a first height at said rear surface and a second height at a position inward of said surface, said second height being greater than said first height; wherein said extension comprises a cam having at least a maximum diameter and a smaller minimum diameter, said cam minimum diameter being smaller than said first groove height, and said cam maximum diameter being greater than said first groove height and less than or substantially equal to said second groove height; and wherein said step of attaching said extension to said valance comprises inserting said cam transversely into said groove and then rotating said cam with respect to said valance to form a tight fit between said mounting bracket and said valance.

48. A method according to claim 47 wherein said rotating step comprises rotating said cam with respect to said valance by approximately 90°.

49. A method according to claim 44 wherein one of said first portion and said first slide includes a tongue, the other of said first portion and said first slide includes a groove, further comprising the step of breaking off one end of said tongue to shorten its length.

50. The method of claim 49 wherein said tongue is provided with at least one weakened line, and said breaking takes place along said weakened line.

51. A method according to claim 44 wherein said adjusting is in increments of approximately 1/16".

* * * * *

UNITED STATES PATENT AND TRADEMARK OFFICE

CERTIFICATE OF CORRECTION

PATENT NO. : 6,672,359 B2
DATED : January 6, 2004
INVENTOR(S) : John E. Morris

It is certified that error appears in the above-identified patent and that said Letters Patent is hereby corrected as shown below:

Column 14,
Line 32, delete “or 44”.

Signed and Sealed this

Fourth Day of May, 2004

JON W. DUDAS
*Acting Director of the United States Patent and Trademark Office*